US008464996B2

(12) United States Patent
Spindler et al.

(10) Patent No.: US 8,464,996 B2
(45) Date of Patent: Jun. 18, 2013

(54) JUMP FORM SYSTEM

(75) Inventors: Robert A. Spindler, Des Plaines, IL (US); Robert J. Flathau, Des Plaines, IL (US)

(73) Assignee: Dayton Superior Corporation, Dayton, OH (US)

( * ) Notice: Subject to any disclaimer, the term of this patent is extended or adjusted under 35 U.S.C. 154(b) by 1031 days.

(21) Appl. No.: 12/357,856

(22) Filed: Jan. 22, 2009

(65) Prior Publication Data

US 2009/0189053 A1 Jul. 30, 2009

Related U.S. Application Data

(60) Provisional application No. 61/022,778, filed on Jan. 22, 2008.

(51) Int. Cl.
*E04G 13/04* (2006.01)

(52) U.S. Cl.
USPC ..... 249/20

(58) Field of Classification Search
USPC ..... 249/20, 21, 19, 23; 425/63, 65
See application file for complete search history.

(56) References Cited

U.S. PATENT DOCUMENTS

| | | | | | |
|---|---|---|---|---|---|
| 2,391,610 | A * | 12/1945 | Altimus | 213/188 |
| 2,523,500 | A * | 9/1950 | Davey et al. | 280/513 |
| 3,514,980 | A * | 6/1970 | Doyle | 70/258 |
| 4,016,228 | A * | 4/1977 | Schmidt | 264/33 |
| 4,043,457 | A * | 8/1977 | Miller et al. | 213/75 B |
| 4,290,576 | A * | 9/1981 | Schworer | 249/20 |
| 4,397,441 | A * | 8/1983 | Manderla | 249/19 |
| 4,562,989 | A | 1/1986 | Scheller | |
| 4,611,784 | A * | 9/1986 | Gallis | 249/20 |
| 4,793,438 | A * | 12/1988 | Perry | 182/112 |
| 5,109,953 | A * | 5/1992 | Mathis | 182/129 |
| 5,630,482 | A * | 5/1997 | Schw orer | 182/82 |
| 6,260,311 | B1 * | 7/2001 | Vladikovic | 52/122.1 |
| 6,557,817 | B2 * | 5/2003 | Waldschmitt et al. | 249/20 |
| 7,513,480 | B2 * | 4/2009 | Bergaretxe et al. | 249/20 |
| 7,926,832 | B1 * | 4/2011 | Hall | 280/441.2 |
| 7,938,380 | B2 * | 5/2011 | Becker | 249/219.1 |
| 2009/0108147 | A1 * | 4/2009 | Di Biase | 248/157 |
| 2010/0038518 | A1 * | 2/2010 | Schwoerer | 249/20 |

OTHER PUBLICATIONS

"Sky-Lift™ Application Guide," by Symons Corporation (24 pages) (2002).
English translation (received Jan. 17, 2012), Office action, Columbian Patent Application 09 005.529, issued Dec. 28, 2011.

* cited by examiner

*Primary Examiner* — Janet M Wilkens
*Assistant Examiner* — Timothy M Ayres
(74) *Attorney, Agent, or Firm* — Thompson Hine L.L.P.

(57) ABSTRACT

A jump form system provided variously with an integral jump shoe lock mechanism, a reversible gang form shear platform, and a pinion lock mechanism for a roll back carriage. The jump shoe lock mechanism includes a lever pivotably mounted to the jump form system frame above a jump shoe bearing portion of a connecting member, a sleeve mounted to the jump form system frame below the jump shoe bearing portion of the connecting member, and a sleeve-mounted safety pin that is mechanically linked to the lever for engagement and disengagement with a jump shoe. The pinion lock mechanism includes a rack and pinion provided on inner and outer portions of a telescoping carriage assembly, respectively, and a lock arm pivotably mounted to the outer portion adjacent to the pinion, with the rack, pinion, and lock arm including complementary teeth which are locked into place upon pivoting engagement of the locking arm.

16 Claims, 8 Drawing Sheets

--Prior Art--

--Prior Art--

JUMP FORM SYSTEM

This application claims the benefit of U.S. Provisional Patent Application No. 61/022,778, filed Jan. 22, 2008, the entire contents of which are incorporated by reference.

TECHNICAL FIELD

The present disclosure relates to concrete forming systems, and more particularly to climbing form systems and jump form systems used to construct vertical concrete walls in a series of discrete sections or lifts.

BACKGROUND

Crane-movable form systems known variously as climbing form systems and jump form systems are frequently employed to construct vertical concrete walls for mid-rise structures such as buildings and silos. The basic components of such devices, hereinafter referred to as jump form systems, are shown in FIG. 1. and consist of a jump form frame 400 and form assembly 410, with the frame 400 including a work platform bearing member 420 supporting a work platform 430, a vertical frame member 440 bearing against the wall under construction, and a diagonal frame member 450 which, together with the work platform bearing member 420, vertical frame member 440, and in some systems, auxiliary bracing 452, 454, form a truss which is suspended from jump shoes 480 embedded within previously constructed sections or "lifts" of a concrete wall during the construction process. The primary purpose of modern jump form systems is to support a movable roll back carriage 460 which allows workers on the work platform 430 to prepare, strip, and clean the form assembly 410 while suspended from a prior lift, so that a crane is employed only from time to time to hoist the jump form onto a newly constructed lift, or to remove the jump form system after the completion of that portion of the work. Trailing platforms 470 are typically used to allow for post-tensioning, removal of the jump shoes 480, and patching and other finish work, while auxiliary platforms 472 are typically mounted to the form assembly 410 and roll back carriage 460 to allow for access to the upper and top portions of the forms, which are generally approximately one story tall.

While the basic components of jump form systems are simple and well developed, there are several safety and performance-related features in existing jump form systems that are functional, but not necessarily easy to use. For example, as will be described in further detail below, existing jump form systems generally require workers manually install and remove safety pins to secure the jump form frame within the jump shoes during the construction process. Manipulation of the safety pins may require workers to cantilever off the edge of a working platform or reach through narrow gaps in order to access the connection between the jump form frame and the jump shoe, which typically lies underneath the work platform itself. Thus, installation can be difficult, safety pins can be dropped or otherwise lost, and additional safety procedures must be observed. In a similar vein, existing jump form systems tend to use pin-type locking mechanisms to secure the roll back carriage in position during hoisting operations, but these mechanisms provide very little positional granularity so that a mounted form can be locked into only a handful of positions during the hoisting process. This lack of flexibility requires a trial-and-error procedure where the jump form system is suspended within the confines of a jump shoe, the roll back carriage is secured in a position that coarsely distributes weight so that the jump form system is approximately plumb and level, and some further operation such as tilting the form assembly is used to finely distribute weight so that the jump form system can be hoisted within significant rotation or tilt. This procedure consumes valuable crane time, and again additional safety procedures must be observed. In addition, due to the variety of gang form systems and panel form systems available in the market, jump form systems typically include or require the manufacture of specialized form-mounting hardware accessories in order to allow for even a limited number of form systems to be mounted on a jump form system. Thus, there is a need for a jump form system which provides for simplified installation of safety devices, greater flexibility in the positioning and securing of a roll back carriage, and a simplified inventory of system hardware. This need is addressed through the various improvements described below.

SUMMARY

In a first aspect, a jump form system provided with an integral jump shoe lock mechanism including a lever pivotably mounted to the jump form system frame above a jump shoe bearing portion of a connecting member, a sleeve mounted to the jump form system frame below the jump shoe bearing portion of the connecting member, and a sleeve-mounted safety pin that is mechanically linked to the lever such that the pin may be advanced out of the sleeve for engagement with a jump shoe or withdrawn into the sleeve for disengagement from the jump shoe. The jump shoe may include a wall bearing plate for installation over an anchor point, a frame bearing plate projecting perpendicularly outward from the wall bearing plate and providing a socket for receiving the connecting member, and a shear reinforcement extending across the outer edge of the frame bearing plate, with the safety pin engaging the underside of the shear reinforcement when the jump shoe lock mechanism is engaged.

In a second aspect, a jump form system provided with form mounting hardware including a reversible gang form shear platform. The gang form shear platform includes a base plate and a pair of opposing and spaced apart mounting arms extending perpendicularly upward from the plate in an off-center position such that the plate provides first and second oppositely directed and differently sized platforms, with the first platform sized to extend under a majority of the depth of a form assembly having a first predetermined depth, and the second platform sized to extend under a majority of the depth of a form assembly having a second predetermined depth. The mounting arms are configured to engage a vertical waler that is secured to a form assembly, and include a plurality of through holes configured to align with both a plurality of through holes included the vertical waler and a plurality of through holes or apertures included in a waler bracket that cantilevers the form assembly and form mounting hardware from the head of a roll back carriage.

In a third aspect, a jump form system provided with a pinion lock mechanism for securing the roll back carriage. The pinion lock mechanism includes a rack affixed to an inner portion of a telescoping carriage assembly, a pinion rotatably mounted on an outer portion of a telescoping carriage assembly for engagement with the rack, and a lock arm pivotably mounted to the outer portion adjacent to the pinion, with the rack, pinion, and lock arm including complementary teeth such that the pinion will be locked into place on the rack when the lock arm is pivoted into engagement with the pinion. The lock arm may include an aperture or loop configured to align with an aperture in the outer portion of the telescoping carriage assembly when the lock arm engages the pinion so as to accept a securement.

DETAILED DESCRIPTION

In a first aspect of the disclosure, a jump form system is improved through the provision of an integral jump shoe lock mechanism 100. The lock mechanism 100 may generally include a lever 110 pivotably mounted to a jump form system frame above a jump shoe bearing portion, a sleeve 150 mounted to the frame below the jump shoe bearing portion, and a sleeve-mounted safety pin 170 which is mechanically linked to the lever 110 such that the pin 170 may be advanced out of the sleeve 150 for engagement with a jump shoe or withdrawn into the sleeve 150 for disengagement from the jump shoe. The provision of an integral jump shoe lock mechanism 100 may simplify installation and increase worker safety by eliminating the need for workers to install a separate safety pin to secure a jump form system within a jump shoe, and may advantageously provide a mechanical advantage which allows for easier manipulation of a safety pin that has become fouled during the construction process.

Figure 1:
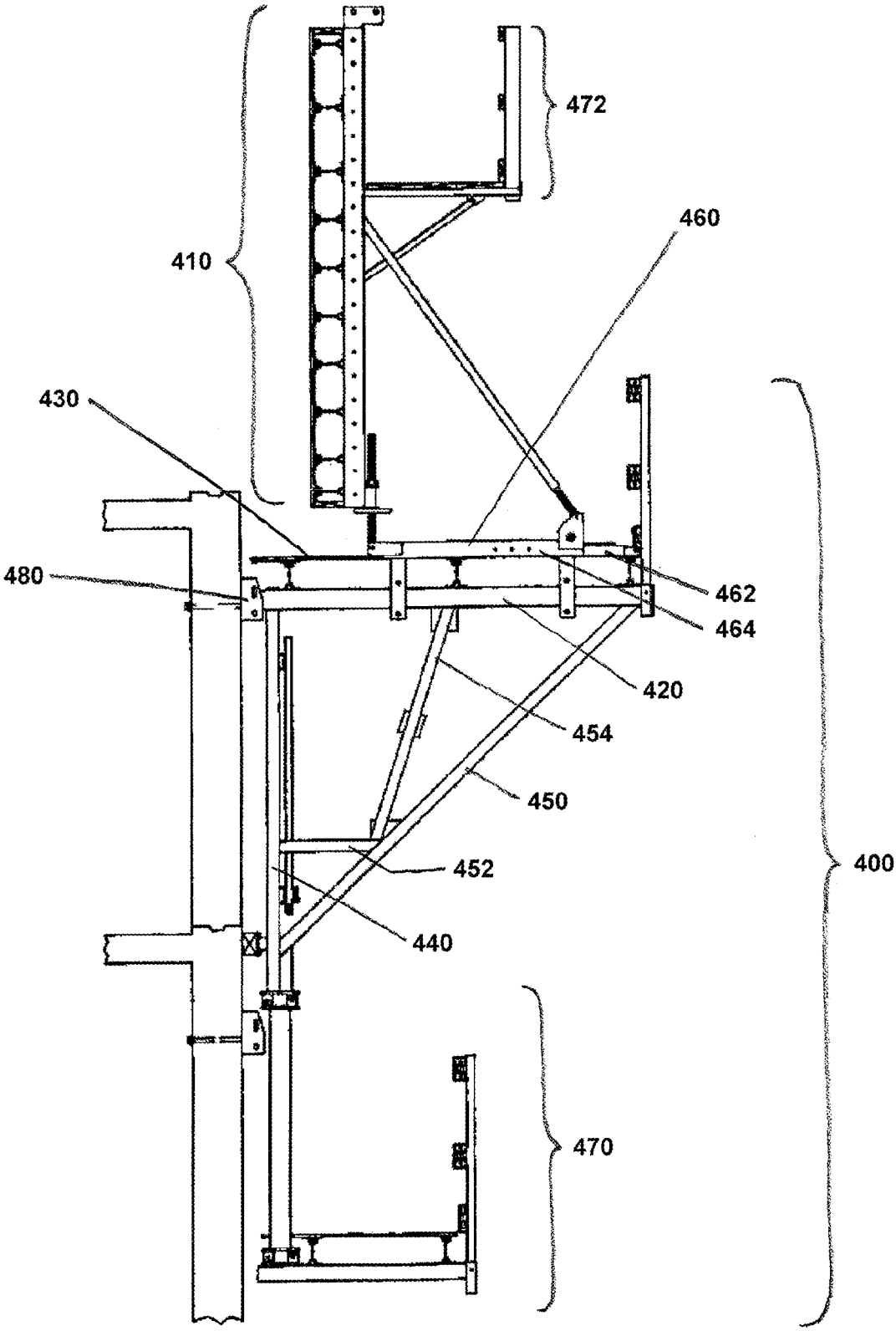
FIG. 1 is a side view of a jump form system.

With reference to FIG. 1, the basic mechanism for connecting a jump form system frame 400 to a wall is well known in the art. A plurality of jump shoes 480 are installed over anchor points formed into the uppermost lift of an unfinished concrete wall, and the frame 400 and other elements of the jump form system are subsequently lowered into the jump shoes 480 by a crane. Connecting members of the jump form system frame 400, most typically proximal ends of the work platform bearing members 420, provide a bearing surface 422 and a depending plate or setting pin 424 (shown in FIGS. 2 and 4) which engage elements of the jump shoe 480 to suspend the jump form system from the existing lift. The connections between the connecting members and the jump shoes 480 can support the load of the jump form system and resist lateral forces generated during construction work, but cannot resist a live load reversal such as that which might occur during windy conditions, especially if auxiliary walkways and/or trailing platforms are installed on the jump form system. Consequently, immediately after lowering a jump form system frame 400 into engagement with the jump shoes 480, workers must install a number of safety pins 484 (shown in FIGS. 2, 3, and 4) to secure the connecting members within the associated jump shoes 480. Conversely, immediately before hoisting a jump form system frame 400 out of the jump shoes 480, workers must remove the safety pins 484 in order to release the connecting members.

Figure 2:
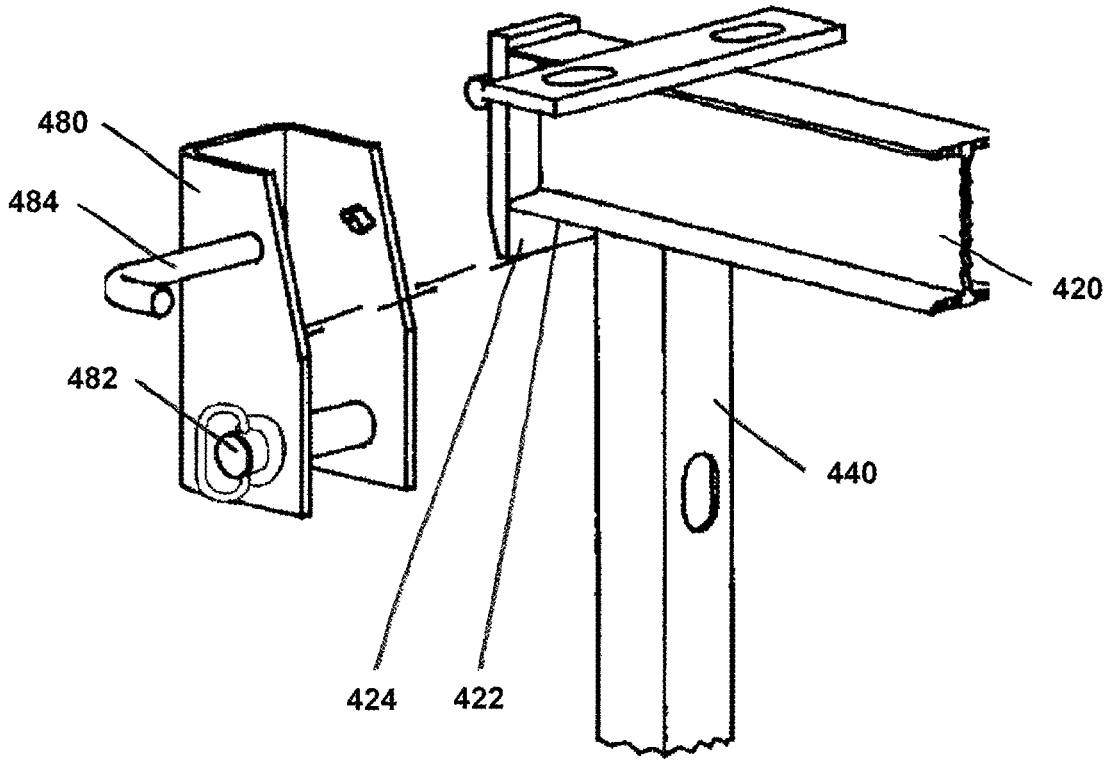
FIG. 2 is a perspective view of a jump shoe connection known in the art.
Figure 3:
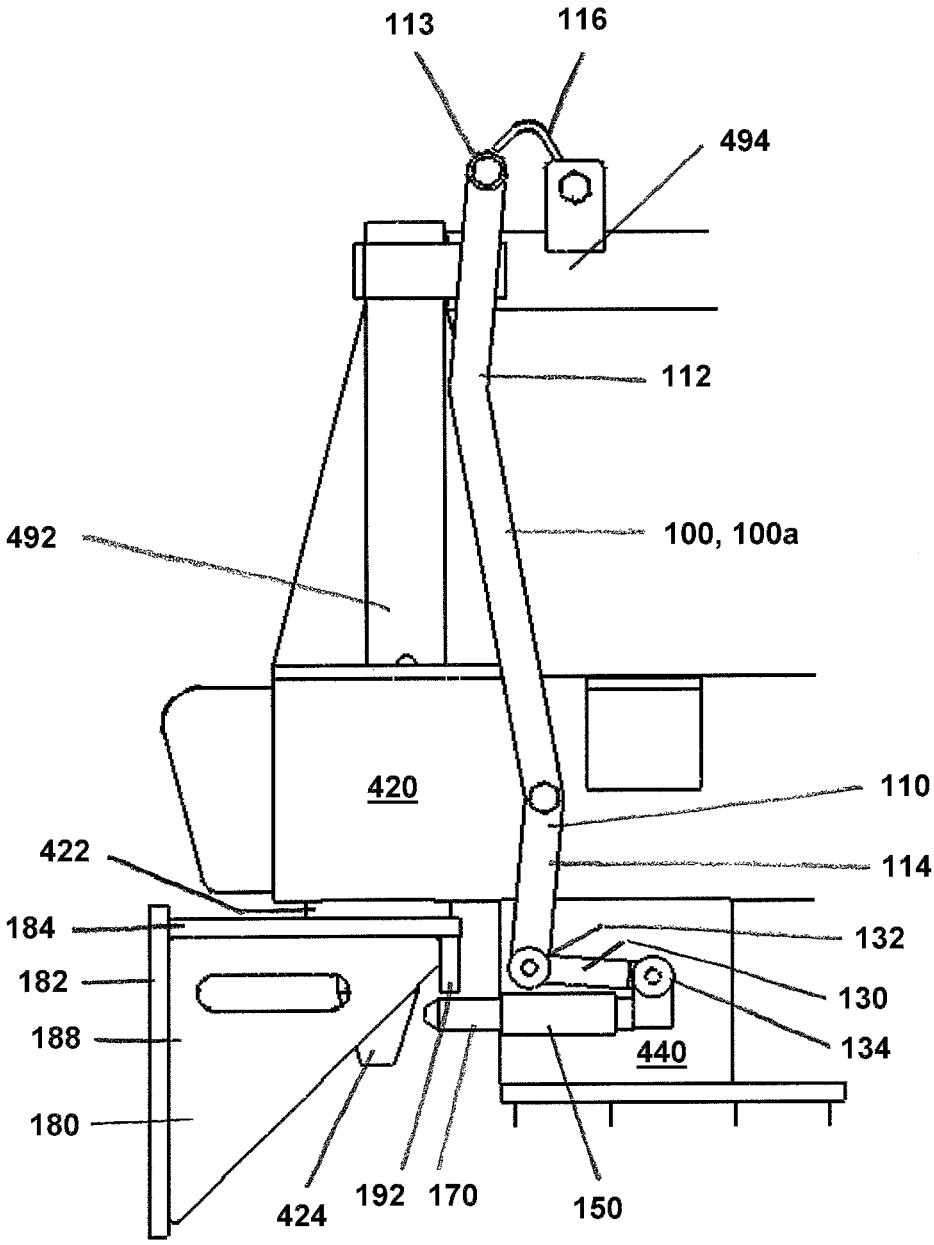
FIG. 3 is a side view of a disclosed jump shoe lock mechanism.
Figure 4:
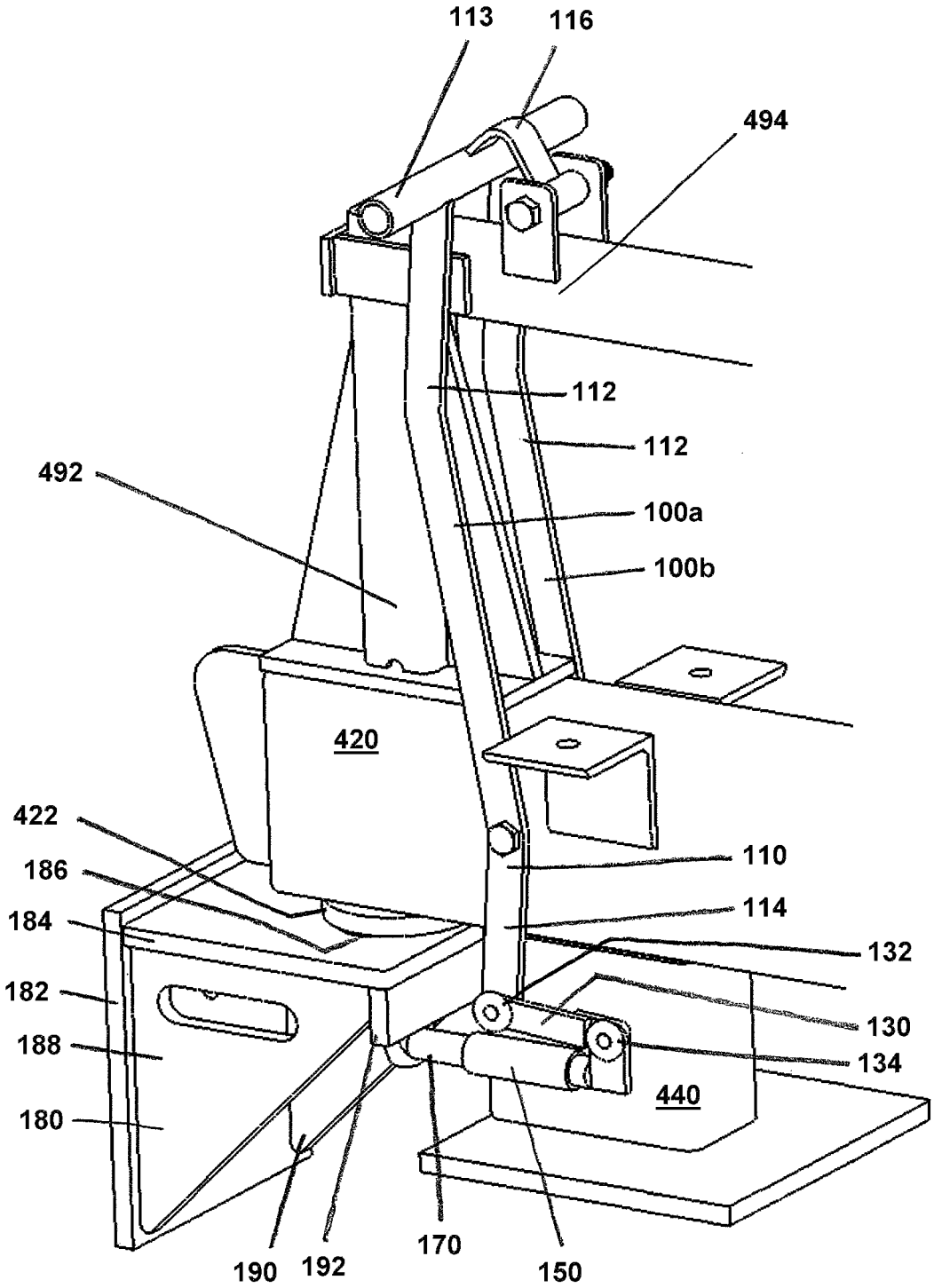
FIG. 4 is a perspective view of the jump shoe lock mechanism in FIG. 3.

FIG. 2 shows a known connection used in the Sky-Lift™ jump form system marketed by Symons of Des Plains, Ill. (USA). A jump shoe 480 having the form of a U-shaped channel includes a transversely mounted support pin 482 and receives a transversely mountable and self-locking safety pin 484 in order to bracket the proximal end of a work platform bearing member 420. In contrast, FIGS. 3 and 4 show a jump shoe 180 designed for use with the improved jump form system. The jump shoe 180 may include a wall bearing plate 182 for installation over an anchor point, a frame bearing plate 184 projecting perpendicularly outward from the wall bearing plate 182 and providing a socket 186 for receiving a setting pin 424 depending from a connecting member of the jump form system frame 400, a pair of opposing and spaced apart gussets 188, 190 extending between the sides of the wall bearing plate 182 and the frame bearing plate 184, and a shear reinforcement 192 extending across the outer edge of the frame bearing plate 184. As shown, the jump shoe lock mechanism 100 may engage the underside of the shear reinforcement 192 to secure the end of the connecting member within the jump shoe 180. However it will be recognized that the jump shoe locking mechanism 100 could also be used with other jump shoe designs. For example, the jump shoe 480 shown in FIG. 2 could be modified by replacing the illustrated support pin 482 with a support pin providing extended shaft portions projecting beyond side walls of the U-shaped channel. In such a design the safety pin 170 of the jump shoe locking mechanism 100 would engage the undersides of those extended shaft portions to secure the end of the connecting member within the jump shoe 480.

With further reference FIGS. 3 and 4, the lever 110 of the jump shoe locking mechanism 100 is pivotably mounted to a member of the jump form system frame 400 above the jump shoe bearing portion 422 of a connecting member such as work platform bearing member 420. The lever 110 provides a handle end 112 that may be configured to extend above the work platform bearing member 420 so as to be operable from the work platform 430 of the jump form system. The lever 110 also provides a linkage end 114 that extends below the jump shoe bearing portion 422 of the connecting member. The linkage end 114 is operatively connected to a mechanical linkage 130 that translates the arcuate travel of the linkage end 114 into a linear travel of a sleeve-mounted safety pin 170. This mechanical linkage 130 may be a simple bar pivotably connected to the linkage end 114 of the handle 110 at a first end 132, and pivotably connected to the safety pin 150 at a second end 134, however alternate linkages may also be used to obtain the same result. The lever 110 is shown as being mounted to a work platform bearing member 420 but may alternately be pivotably mounted to other fixed members of the jump form system frame 400 such as the roll back carriage brace 492, although in many cases such a mounting would sacrifice the mechanical advantage provided by the illustrated mounting.

The sleeve 150 of the jump shoe locking mechanism 100 is fixedly mounted to the jump form system frame 400 below the jump shoe bearing portion 422 of the connecting member, e.g., the underside of work platform bearing member 420 and, as shown, may be mounted to the vertical member 440 of the jump form system frame 400 below that bearing portion 422. The sleeve 150 secures the safety pin 170 to the frame such that the pin 170 may be advanced out of the sleeve 150 by the mechanical linkage 130 for engagement with a jump shoe or withdrawn into the sleeve 150 by the mechanical linkage 130 for disengagement from the jump shoe, but is otherwise held in place by the sleeve 150. Thus uplift forces acting on the jump form system frame 400 will be transferred to the sleeve 150, to the safety pin 170, and ultimately to an underside of the associated jump shoe, such as the shear reinforcement 192 of the jump shoe 180.

Sleeve 150 and safety pin 170 are preferably mounted essentially horizontally on the jump form system frame 400 to prevent uplift forces from being transmitted to the mechanical linkage 130, which would require resistance by the lever 110. In addition, because safety pin 170 may serve as the sole active means of resisting uplift forces in the jump form system, the jump shoe locking mechanism 100 is preferably duplicated on both sides of the connecting member, e.g., with first and second portions 100*a*, 100*b* being mounted on opposite sides of the work platform bearing member 420, adjacent the jump shoe bearing surface 422 and plate or setting pin 424, to provide both increased resistance to uplift forces and a measure of redundancy to the mechanism. As suggested within FIGS. 3 and 4, the lever 110, mechanical linkage 130, sleeve 150, and safety pin 170 may be duplicated on opposite sides of the connecting member, and the first and second handle ends 112 may be joined by a unitary handle 113 to simplify operation of the mechanism. The mechanism may also include a clasp 116 mounted on an adjacent portion of the jump form system frame 400 such as the roll back carriage brace 492 or the head of the inner roll back carriage assembly 494 as shown in FIGS. 3 and 4. The provision of the unitary handle 113 and clasp 116 permits the connecting member to be secured within a jump shoe in a single operation, whole allowing the mechanism to be secured against accidental disengagement during construction work.

In a second aspect of the disclosure, the jump form system is improved through the provision of form mounting hardware including a reversible gang form shear platform 240. The form mounting hardware may generally include a waler bracket 200, a gang form shear platform 240, and a vertical waler 280 that is secured to a gang form assembly or a panel form assembly constructed from panels such as the Versi-form®, Steel-Ply®, or Flex-Form® systems marketed by Symons of Des Plains, Ill. (USA). The gang form shear platform 240 includes two oppositely directed and differently sized form-supporting platforms 252, 254, and may be mounted with either platform extending under a form assembly. The different depths allow for comparatively shallow form assemblies, such as a 2½" deep panel form assembly, to be mounted using the same hardware as comparatively deep form assemblies, such as an 8" deep aluminum beam gang form assembly, without risking racking or damage of the form. For avoidance of doubt, the term racking is used to describe a situation in which the face of a form assembly is insufficiently supported, and shear forces acting on the beams, frames, or other intermediate members of the assembly cause the face of the assembly sag downwards with respect to the assembly's connection to the jump form system, distorting the form assembly out of alignment and, if the shear forces are severe, permanently deforming elements of the form assembly itself.

Figure 5:
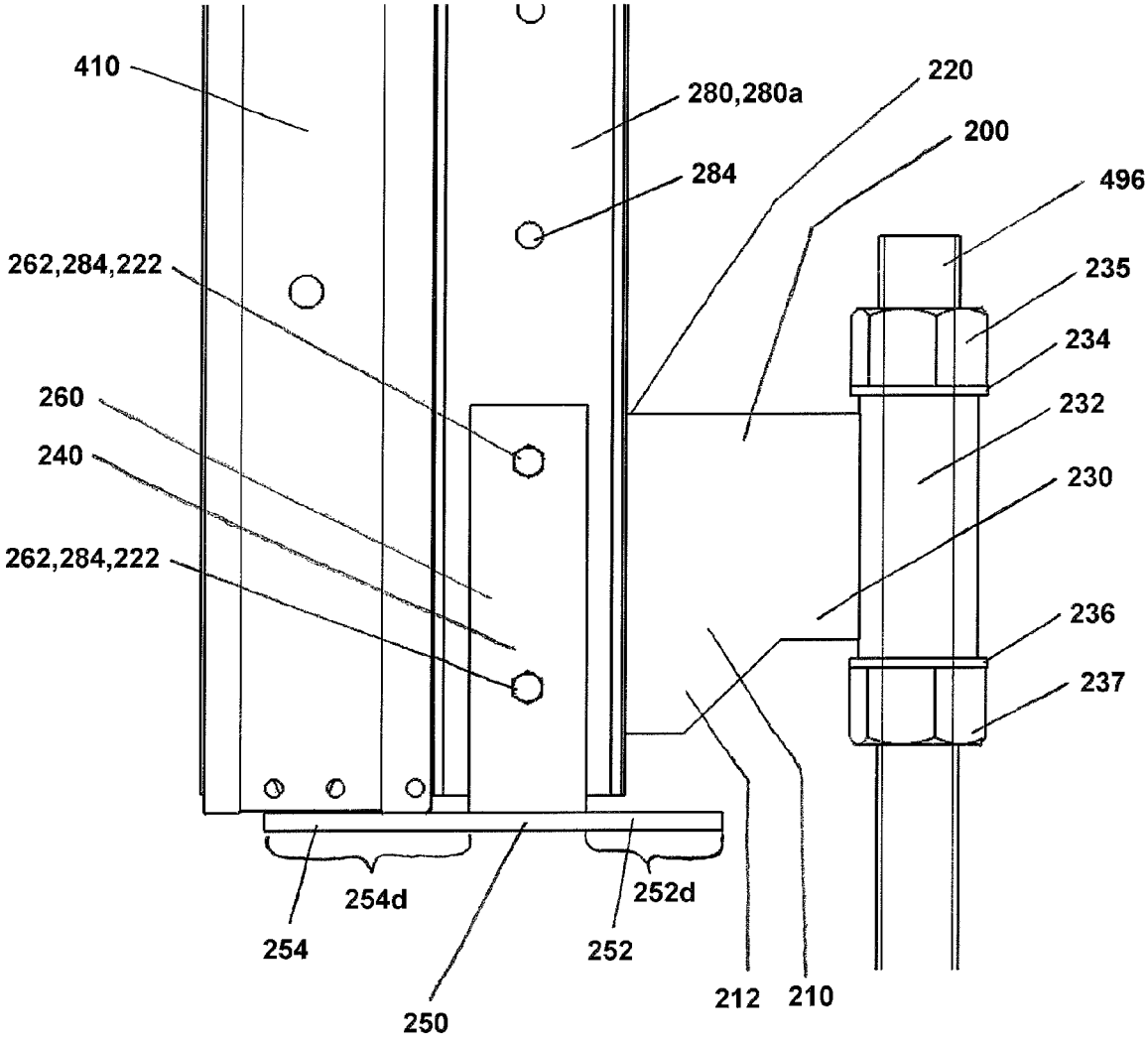
FIG. 5 is a side view of disclosed form mounting hardware including a reversible gang form shear platform.
Figure 6:
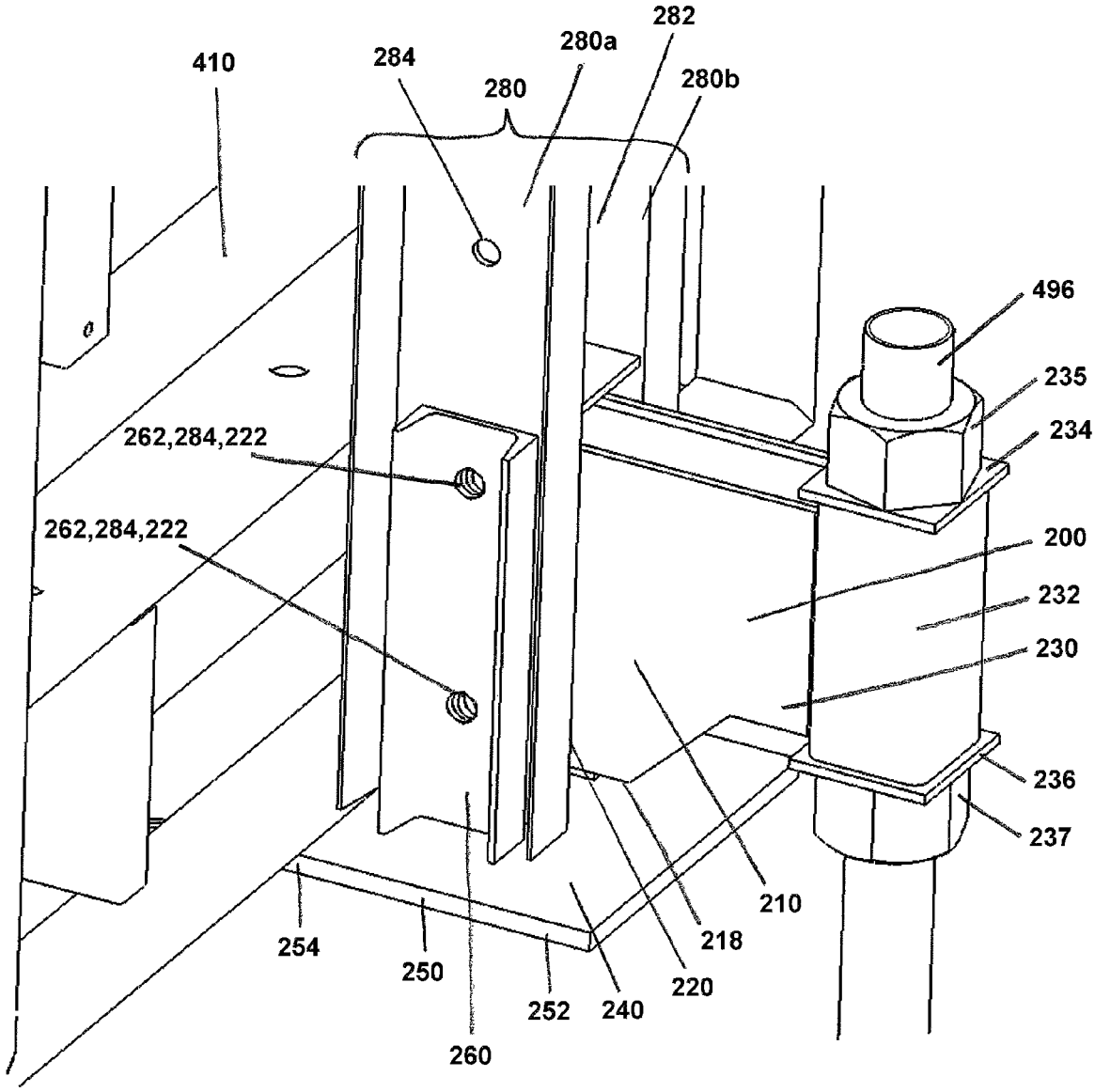
FIG. 6 is a perspective view of the form mounting hardware in FIG. 5.

The vertical waler 280 of the mounting hardware may be a conventional waler used in the construction of beam gang form assemblies or the reinforcement of panel form assemblies. Such walers typically consist of a pair of opposing and spaced apart channels installed across the form assembly so that the bights of each channel 280*a*, 280*b* form an elongated rectangular slot 282 running vertically along the assembly. Alternate walers suitable for use could range from a U-shaped channel having a comparatively narrow bight and a pair of comparatively deep legs to a pair of opposing and spaced apart rectangular-profiled bars, depending upon design of the walers and intermediate form assembly members involved. The vertical waler 280 in FIGS. 5 and 6 is shown as the aforedescribed pair of channels, but it will be recognized that the improvement may be used with almost any waler-type reinforcement providing a pair of opposing and spaced apart elements defining a central slot 282. Such waler reinforcements generally include an array of mutually aligned through holes 284 for the attachment of accessories such as walkway brackets, diagonal braces, and lifting hardware, but if such through holes are absent or too widely spaced, the walers may be redesigned and modified to permit the installation of the waler bracket 200 and gang form shear platform 240 in the manner described below.

Referencing FIGS. 5 and 6, the waler bracket 200 of the mounting hardware acts as a cantilever to position the form assembly at the head of the jump form system roll back carriage. The waler bracket 200 generally comprises a body 210 including a first end 220 adapted for insertion into the vertical waler slot 282, e.g., between the bights of the constituent channels 280*a*, 280*b*, and a second end 230 configured for attachment to the roll back carriage. The body 210 of the bracket includes first and second opposing sidewalls 212, 214, with portions at the first end 220 being adapted to abut the respective opposing elements defining the channel 282. Top and bottom walls 216, 218 may extend between the first and second sidewalls to form a box-beam type structure and, optionally, internal ribs 219 (omitted for clarity) may subdivide the structure to reinforce the body 210. Less preferably, the body 210 may be a generally solid beam including a solid or forked first end, with portions of the first and second opposing sidewalls 212, 214 at the first end 220 being similarly adapted to abut the opposing elements defining the channel 282. The first and second opposing sidewalls 212, 214 at the first end 220 include a plurality of apertures or through holes 222 configured to align with the plurality of through holes 284 in the vertical waler.

The second end 230 of the body 210 is configured for attachment to the roll back carriage through any of number of means used in the art. For example, FIGS. 5 and 6 show a portion of the Sky-Lift™ jump form system marketed by Symons of Des Plains, Ill. (USA). A waler bracket 200 intended for use with such a system may include a sleeve 232 configured to slide over a screw jack 496 provided at the head end of the jump form system roll back carriage. Such a sleeve 232 might include integral top and bottom walls 234, 236 to provide a bearing surface for nuts 235, 237 that position and secure the waler bracket 200 to the screw jack 496, or be combined with oversized washers sized to provide such a bearing surface. Nuts 235, 237 are shown as hex nuts but could be any complementary fastener element, such as a handle nut, and the second end 230 of the body 210 may be configured to include a notched length to provide clearance for tools such as a wrench or handle nut.

The gang form shear platform 240 of the improvement acts as a primary support for the forms, acting in concert with the vertical waler 280 to support the form assembly. The gang form shear platform 240 generally comprises a base plate 250 and a pair of opposing and spaced apart mounting arms 260 extending perpendicularly upward from the plate 250. Each mounting arm 260 is configured to engage one of the opposing elements of the vertical waler 280 opposite the slot 282, and is affixed to the base plate 250 in an off-center position such that the plate 250 provides a first platform 252 extending away from the mounting arms 260 for a first distance 252*d* and an oppositely directed second platform 254 extending away from the mounting arms 260 for a second distance 254*d*. The mounting arms 260 include a plurality of through holes 262 configured to align with both the plurality of through holes 284 included in the vertical waler 280 and the plurality of apertures or through holes 222 included in the waler bracket 200.

The gang form shear platform 240, vertical waler 280, and waler bracket 200 may be releaseably secured together via fasteners passing through the through holes 262, 284 and apertures or through holes 222 of the mounting hardware. Exemplary fasteners suitable for use would include bolts, threaded rods, and clevis pins in combination with complementary securements. The gang form shear platform 240 is reversible in that it may be secured to the vertical waler 280 and waler bracket 200 with either the first platform 252 extending outward and under a ganged assembly or the second platform 254 extending outward and under that ganged assembly. The other platform may consequently extend inward and back along the body 210 of the waler bracket 200 without further obstructing access to the second end 230 of the waler bracket 200 and/or the means for attachment to the roll back carriage. This arrangement of the other platform and the waler bracket 200 also advantageously prevents the inward-oriented platform from presenting an additional injury hazard to workers on the working platform.

The oppositely directed and differently sized form-supporting platforms 252, 254 of the gang form shear platform 240 are sized such that the first platform 252 will extend under a majority of the depth of a form assembly having a first predetermined depth without extending beyond the face of that assembly, and the second platform 254 will extend under a majority of the depth of a form assembly having a second predetermined depth without extending beyond the face of that form assembly. For example, the first platform 252 may extend for a first distance 252*d* of 5¼" to support a beam gang form assembly comprising a ¾" plywood face, a 7¼" deep horizontal beam. and a 5" vertical waler 280, while the second platform 254 may extend for a second distance 254*d* of 3½" to support a panel form assembly comprising a 2½" deep panel and a 5" vertical waler 280. The gang form shear bracket may then be mounted with the first platform 252 extending outward from the vertical waler 280 and waler bracket 200 for use with the exemplary aluminum beam gang form assembly, or with the second platform 254 extending outward from the vertical waler 280 and waler bracket 200 for use with the exemplary panel form assembly. It will be apparent that the exemplary panel form assembly could not be supported by the first platform 252 without that platform projecting beyond the panel face, and should be apparent that the exemplary beam gang form assembly will experience significant shear forces if supported only by the second platform 254, i.e., that supports providing only one platform would be ill-suited to support both types of form assemblies. The gang form shear bracket 240 thereby reduces the number and kinds of mounting hardware that must be provided to ready the jump form system for use with particular form systems.

In a third aspect, the jump form system is improved through the provision of a pinion lock mechanism 300 in the roll back carriage. The pinion lock mechanism may comprise a rack 310 affixed to an inner portion of a telescoping carriage assembly, a pinion 320 rotatably mounted on an outer portion of a telescoping carriage assembly over the rack 310 for engagement with the rack 310, and a lock arm 330 pivotably mounted to the outer portion adjacent to the pinion 320 for engagement with the pinion 320. The rack 310, pinion 320, and the lock arm 330 include complementary teeth such that the pinion 320 will be locked into place on the rack 310 when the lock arm 330 is pivoted into engagement with the pinion 320. The provision of pinion lock mechanism 300 allows workers to lock the roll back carriage in essentially any position along its travel, with the granularity of the positioning being determined by the spacing between teeth along the rack, and simplifies operation of the jump form system by eliminating the need to tilt a form assembly or fine-tune the weight distribution of the jump form system without repositioning the form assembly in order to plumb and level the system for hoisting.

Figure 7A:
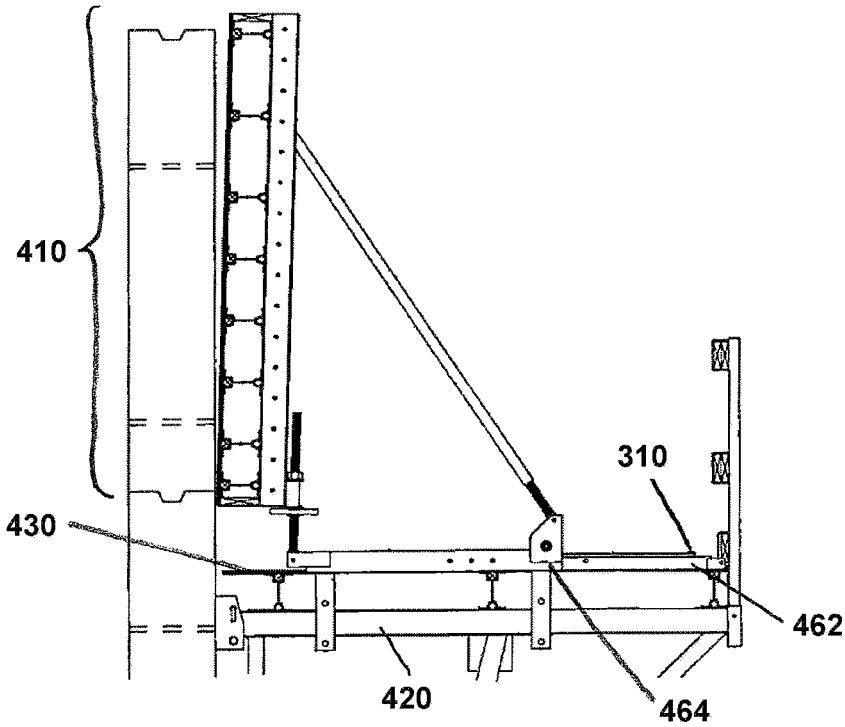
FIGS. 7A and 7B are side views of the operation of a roll back carriage.
Figure 7B:
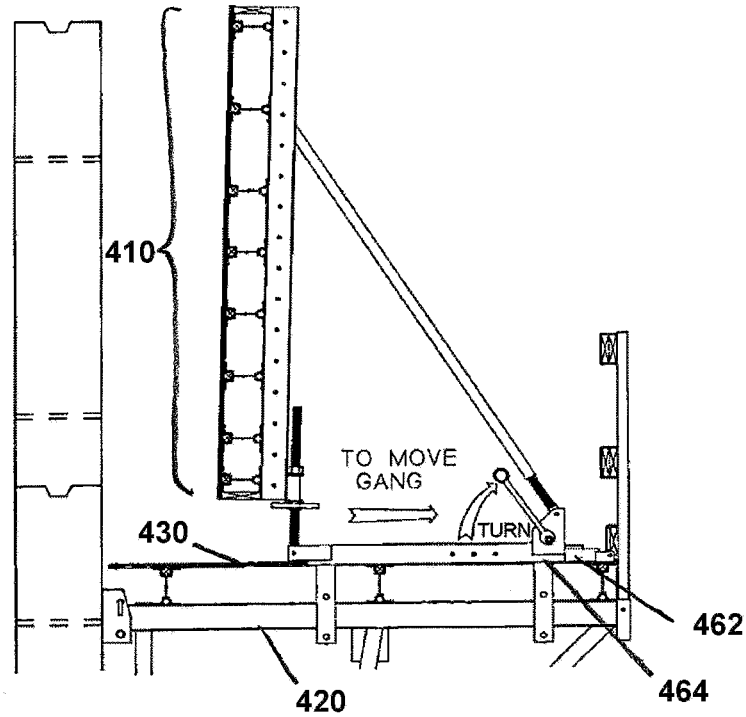

A similar rack 310, inner telescoping carriage assembly 462, and outer telescoping carriage assembly 464 may be found in an existing roll back carriage design used in the Sky-Lift™ jump form system marketed by Symons of Des Plains, Ill. (USA). With reference to FIGS. 1 and 7, the rack 310 may be affixed to the upper surface of an inner roll back carriage assembly 462 that is secured to the jump form system, and an outer roll back carriage assembly 464 may roll along a horizontal member of the jump form system, such as work platform bearing member 420, telescoping over the inner roll back carriage assembly 462 and rack 310 to allow for movement of a mounted form assembly 410. It will be recognized that the rack 310 could be affixed to one of the sides or even on the bottom of the inner roll back carriage assembly 462 in alternate designs, although the top is preferred in order to avoid interference with the work platform 430 of the system.

Figure 8:
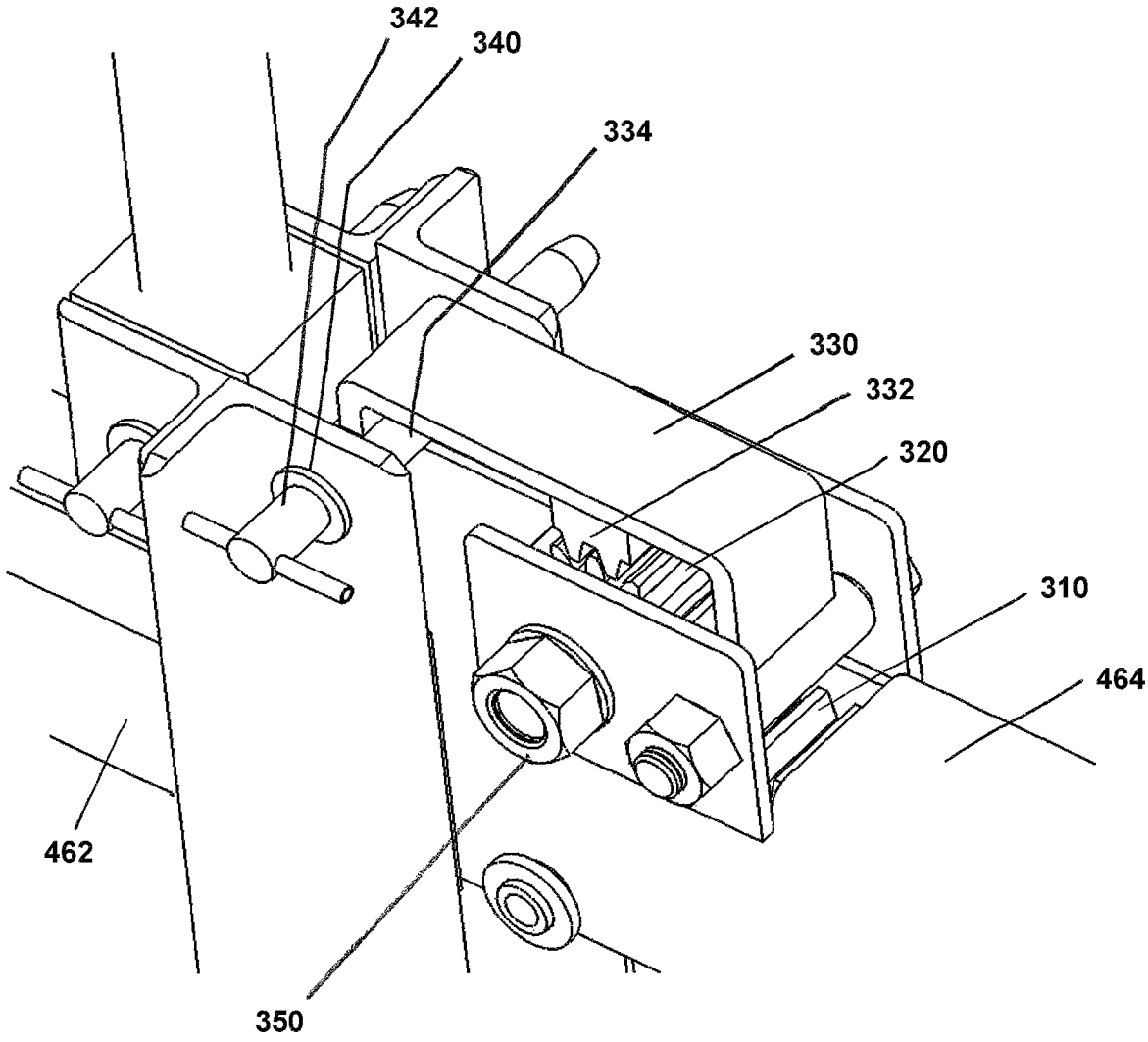
FIG. 8 is a perspective view of a disclosed roll back carriage lock mechanism.

With further reference to FIG. 8, a pinion 320 is rotatably mounted on the outer roll back carriage assembly 464 such that it will engage the rack 310. The lock arm 330 is rotatably mounted on the outer roll back carriage assembly 464 adjacent to the pinion 320 and includes teeth 332 complementary to those of the pinion 320. The lock arm 330 may be rotated into engagement with the pinion 320 to lock the pinion 320, and therefore the outer roll back carriage assembly 464, in place with respect to the inner roll back carriage assembly 462 and rack 310. The lock arm 330 may also be rotated away from engagement with the pinion 320 to allow for normal operation. An adjacent portion of the outer roll back carriage assembly 464 preferably includes a through hole or aperture 340, and the lock arm 330 may include an aperture or loop 334 configured to align with that hole or aperture 340 when the lock arm 330 engages the pinion 320 so as to accept a safety pin, lockout wire and tag, or other securement 342 in order to maintain the roll back carriage in a locked condition.

The pinion 320 may be a stand-alone lock mechanism, or may serve as a drive gear for operation of the roll back carriage assembly 460. In the latter embodiment, the pinion 320 may be rotatably coupled to the head of a bolt, nut, or other headed element of a keyed shaft 350, and a conventional tool such as a simple wrench, ratchet wrench, or drill with socket adapter may be used to operate the roll back carriage. In systems which incorporate multiple gears to provide additional mechanical advantage to the drive hear, any constituent gear in rotating communication with the rack 310 shall be considered to be a pinion for the purposes of the application and claims. It will also be recognized that although the rack 310, pinion 320, and lock arm 330 have been illustrated as having straight teeth, no particular configuration of complementary teeth is necessary for proper operation of the pinion lock mechanism 300, such that straight teeth, helical teeth, and other types of teeth may be employed for similar effect.

Having described the invention in detail and by reference to the preferred embodiments, it will be apparent that modifications and variations thereof are possible without departing from the scope of this disclosure.

What is claimed is:

1. A jump form system having a jump form system frame provided with an integral jump shoe lock mechanism, the jump shoe lock mechanism comprising:

a lever pivotably mounted to the jump form system frame above a jump shoe bearing portion of a connecting member;

a sleeve mounted to the jump form system frame below the jump shoe bearing portion of the connecting member; and a safety pin projecting outwardly toward the jump shoe bearing portion of the connecting member, the safety pin being slidably mounted within the sleeve and mechanically linked to the lever such that the pin may be advanced out of the sleeve for engagement with a jump shoe or withdrawn into the sleeve for disengagement from the jump shoe.

2. The jump form system of claim 1, further including a jump shoe comprising:

a wall bearing plate for installation over an anchor point;

a frame bearing plate projecting perpendicularly outward from the wall bearing plate and providing a socket for receiving the connecting member; and a shear reinforcement extending across the outer edge of the frame bearing plate, wherein the safety pin engages the underside of the shear reinforcement when the jump shoe lock mechanism is engaged.

3. The jump form system of claim 2, the jump shoe further comprising:

a pair of opposing and spaced apart gussets, each extending between a side of the wall bearing plate and a side of the frame bearing plate.

4. The jump form system of claim 1, further including a jump shoe comprising:

a wall bearing channel for installation over an anchor point;

a support pin mounted transversely within the wall bearing channel between opposing channel walls for receiving and supporting the connecting member; and extended support pin shaft portions projecting from the support pin and beyond the opposing channel walls, wherein the safety pin engages the underside of the extended support pin shaft portion when the jump shoe lock mechanism is engaged.

5. The jump form system of claim 1, wherein:

the sleeve is mounted essentially horizontally on the jump form system frame, and the safety pin is slidably mounted essentially horizontally within the sleeve, whereby the lever is substantially isolated from uplift forces acting on the safety pin.

6. The jump form system of claim 1, wherein:

the lever, the sleeve, and the pin constitute a first lever, first sleeve, and first pin disposed on a first side of the connecting member, a second lever, a second sleeve, and a second pin substantially duplicate the first lever, first sleeve, and first pin on a second side of the connecting member, and the first lever and the second lever are joined by a unitary handle.

7. The jump form system of claim 6, the jump shoe lock mechanism further comprising:

a clasp mounted on an adjacent portion of the jump form system frame, the clasp being effective to secure the unitary handle when the jump shoe lock mechanism is operated for locking engagement with a jump shoe.

8. The jump form system of claim 1, wherein the lever is pivotably mounted to a work platform bearing member of the jump form system frame.

9. The form system of claim 8, wherein the connecting member is a proximal end of the work platform bearing member, and the jump shoe bearing portion is disposed on the underside of the work platform bearing member.

10. The form system of claim 9, wherein the jump shoe bearing portion surrounds a depending setting pin.

11. The jump form system of claim 8, wherein a handle end of the lever is configured to extend substantially above the work platform bearing member so as to be operable from a work platform of the jump form system.

12. The jump form system of claim 8, wherein the sleeve is mounted to a vertical member of the jump form system frame depending from the work platform bearing member.

13. The jump form system of claim 1, wherein the lever is pivotably mounted to a roll back carriage brace of the jump form system frame.

14. The jump form system of claim 1, wherein a linkage end of the lever is configured to extend below the below the jump shoe bearing portion of the connecting member.

15. The jump form system of claim 14, wherein the safety pin is mechanically linked to the linkage end of the lever by a bar pivotably connected to the linkage end of the lever at a first end and pivotably connected to the safety pin at a second end.

16. The jump form system of claim 15, wherein the sleeve is mounted to a vertical member of the jump form system frame depending from the work platform bearing member.

* * * * *

UNITED STATES PATENT AND TRADEMARK OFFICE

CERTIFICATE OF CORRECTION

PATENT NO. : 8,464,996 B2
APPLICATION NO. : 12/357856
DATED : June 18, 2013
INVENTOR(S) : Robert A. Spindler and Robert J. Flathau It is certified that error appears in the above-identified patent and that said Letters Patent is hereby corrected as shown below:

In the Claims:

Column 10, Claim 14, Line 39 reads: "end of the lever is configured to extend below the below the"

It should read -- end of the lever is configured to extend below the --

Signed and Sealed this
Seventeenth Day of September, 2013

Teresa Stanek Rea
*Deputy Director of the United States Patent and Trademark Office*